United States Patent [19]

Buechel et al.

[11] 4,382,533

[45] May 10, 1983

[54] EXPLOSIVE POWDER OPERATED SETTING DEVICE

[75] Inventors: Franz Buechel, Ruggell, Liechtenstein; Peter Jochum, Meiningen, Austria

[73] Assignee: Hilti Aktiengesellschaft, Schaan, Liechtenstein

[21] Appl. No.: 257,420

[22] Filed: Apr. 23, 1981

[30] Foreign Application Priority Data

Apr. 28, 1980 [DE] Fed. Rep. of Germany ..... 3016280

[51] Int. Cl.[3] ..... B25C 1/08

[52] U.S. Cl. ..... 227/10; 227/9

[58] Field of Search ..... 227/8, 9, 10, 11

[56] References Cited

U.S. PATENT DOCUMENTS

| | | | |
|---|---|---|---|
| 3,204,400 | 9/1965 | Kvaule | 227/10 X |
| 4,068,790 | 1/1978 | Osterle et al. | 227/10 X |
| 4,153,192 | 5/1979 | Jochum | 227/10 |
| 4,263,836 | 4/1981 | Koine | 227/10 X |

FOREIGN PATENT DOCUMENTS 213796 2/1961 Austria .

*Primary Examiner*—Paul A. Bell

*Attorney, Agent, or Firm*—Toren, McGeady and Stanger

[57] ABSTRACT

An explosive powder operated setting device uses the propellant gases from an ignited explosive powder charge for driving a piston which, in turn, propels a fastening element from the device into a receiving material. The device includes a housing, a barrel mounted in the housing with the piston displaceably mounted in the barrel. A tubular-shaped slide valve is rotatably mounted in the rear portion of the barrel behind the piston. The front end of the slide valve combines with the barrel in forming a space in which the propellant gases contact the piston and drive it through the barrel. The rear end of the slide valve forms a part of the combustion chamber within the device. At its front end, the slide valve is frusto-conically shaped and forms a seal with a correspondingly shaped surface in the barrel. An exhaust duct section extends through the barrel and is in communication with another exhaust duct section in the housing. The slide valve has exhaust openings extending radially through it which can be aligned with the exhaust duct section in the barrel so that, if required, a part of the propellant gases can be exhausted to the atmosphere without being used for driving the piston.

9 Claims, 2 Drawing Figures

EXPLOSIVE POWDER OPERATED SETTING DEVICE

SUMMARY OF THE INVENTION

The present invention is directed to an explosive powder operated setting device for driving fastening elements, such as bolts, studs, nails and the like into a receiving material. The device includes a combustion chamber for an explosive powder charge in communication with a working space. Propellant gases generated in the combustion chamber flow into the working space and drive a piston which in turn drives the fastening element. At least one exhaust duct is provided in the device for releasing at least a portion of the propellant gases. A rotatable tubular slide valve extends between the combustion chamber and the working space and has radially extending openings which can be arranged in alignment with the exhaust duct for releasing a certain portion of the propellant gases out of the device.

For reasons of efficiency and economy it is desirable if a single strength explosive powder charge can be provided for use in an explosive powder operated setting device. Since the setting device is used under conditions where the required driving power is different, if a single strength charge is used then the device must be equipped to regulate its driving power. Basically, there are two different ways of achieving this end, one is the adjustment of the space within the device and another is the release or exhaust of a portion of the propellant gases generated.

To exhaust a part of the propellant gases, it has been known to provide radially extending openings in a rotatable slide valve so that the openings can be aligned with an exhaust duct in the device for releasing a certain portion of the gases. To regulate the amount of exhaust gases by-passed through the exhaust duct, either the radial openings of the slide valve or the exhaust duct can be provided with different cross sectional areas. There is a considerable problem in using such an arrangement because of an insufficient sealing action between the barrel and the slide valve. Since the propellant gases are highly pressurized, the gases can escape uncontrolled even through narrow spaces or openings so that the driving power of the setting device cannot be properly regulated.

Therefore, it is the primary object of the present invention, to provide a slide valve for regulating the driving power of the device which affords a controlled release of a portion of the propellant gases.

In accordance with the present invention, the slide valve is movable in the axial direction within certain limits relative to the barrel and, in the region where the slide valve communicates with the working space behind the piston, it has a frusto-conically shaped funnel-like end part which widens in the direction toward the front end of the device, that is, the direction in which fastening elements are driven from the device. This funnel-like part limits the axial displacement of the slide valve in the direction opposite to the driving direction of the fastening elements.

When the funnel-like part of the slide valve contacts the corresponding frusto-conical surface in the barrel an almost 100% seal is effected. When the propellant gases flow through the passageway in the slide valve to the working space, the slide valve is forced rearwardly with its funnel-like part in surface contact engagement with the frusto-conical surface on the inside of the barrel. The axial movement of the slide valve provides the possibility of moving the slide valve each time a new explosive charge is introduced into the device. Such movement prevents the deposit of combustion residues in the region of the sealing surfaces.

To afford a compact construction of the slide valve it is preferable if the exhaust openings in the valve are located in the funnel-like part. In such an arrangement, the exhaust openings through the valve are surrounded by the sealing surfaces. This assures a particularly effective seal for the working space where the propellant gases contact the piston.

When a fastening element is being driven into a receiving material, the propellant gases, generated when the explosive powder charge is ignited, first act on one end of the slide valve and subsequently act on the other end. To limit the axial displacement of the slide valve in the driving direction of the fastening elements, it is appropriate to provide a stop on a slide valve. The stop prevents the slide valve from being moved forwardly through the barrel in the device so that communication between the exhaust openings through the slide valve and the exhaust duct section in the barrel remain in alignment.

Since the slide valve is rotatably mounted in the barrel, it is preferable if the stop is in the form of an annular collar. Further, the collar, if necessary, can also serve to guide the slide valve.

Within the barrel, the slide valve can be rotated about the axis of the barrel to regulate the driving force transmitted to the piston. Accordingly, it is preferable if the stop involves means for rotating the slide valve. Such means can be in the form of a knob or individual depressions on the periphery of the means. Another possibility is to equip the stop on its circumferential periphery with a toothed gear rim. To prevent the gear rim from projecting outwardly from the surface of the housing, a drive pinion can be mounted in the housing in engagement with the gear rim. The pinion can be positioned so that it protrudes outwardly from the surface of the housing and is available for positioning the slide valve.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figures 1, 2:
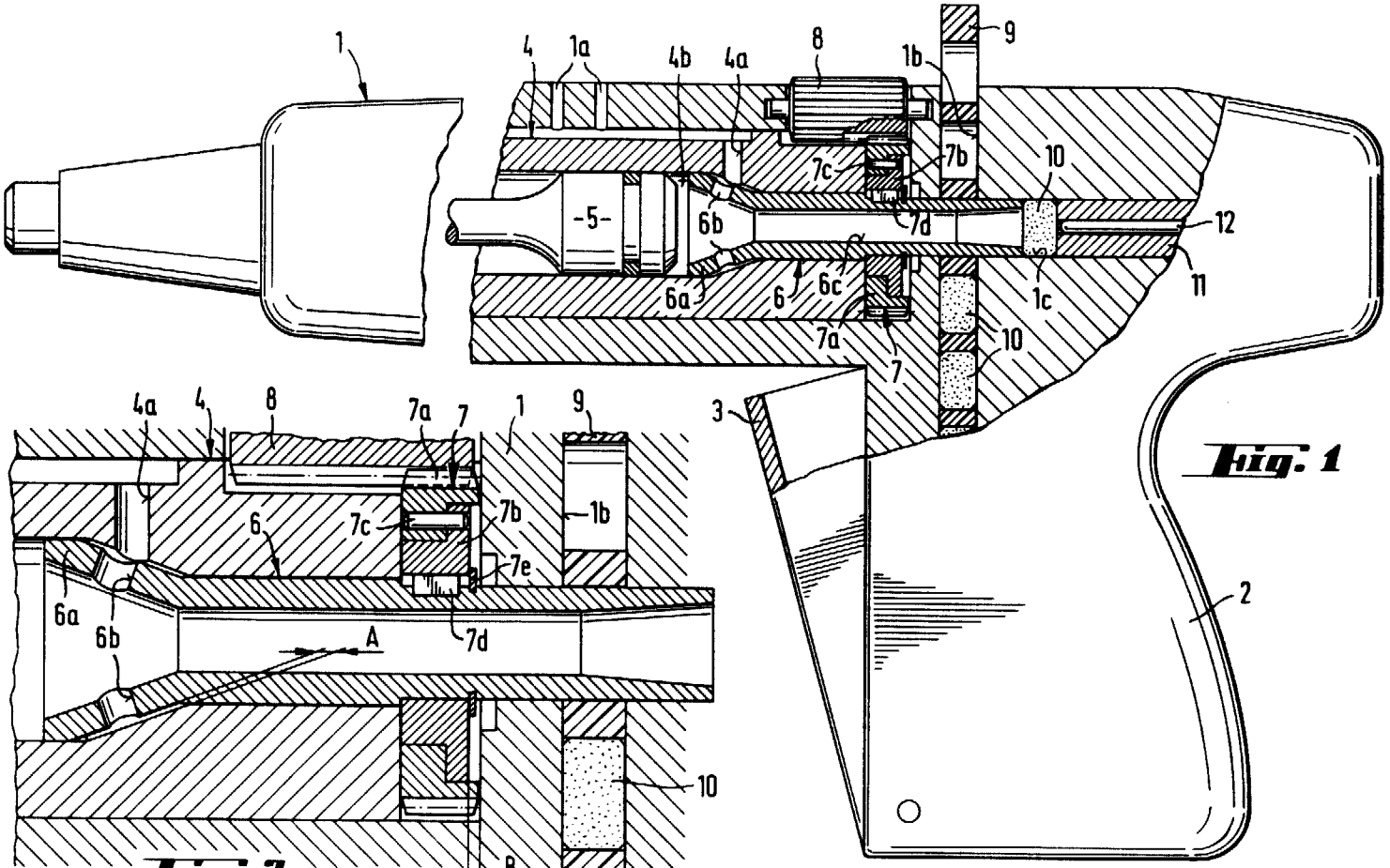
FIG. 1 is a side view, partly in section, of a fastening element setting device embodying the present invention.
FIG. 2 is a partial sectional view of the device shown in FIG. 1 illustrated on an enlarged scale.

The fastening element setting device shown in FIG. 1 consists of a housing 1 having a front end at the left end as viewed in the figure and a rear end at the right end. Adjacent the right end of the housing 1 a pistol-like grip 2 is provided including a trigger 3. An axially elongated barrel 4 is located in the housing 1 and is axially movable within the housing in a manner well known in the art. A driving piston 5 is located within the barrel and is displaceable from the position shown in FIG. 1 toward the front end of the housing for displacing a fastening element out of the setting device into a receiving material. The barrel has a bore within which the piston 5 is axially displaceable. Rearwardly of the piston within this bore is a tubular slide-valve 6 extending rearwardly through the end of the barrel into a bore formed in the housing. An annular collar 7 is fastened on the slide valve 6 at the rear end of the barrel 4. Collar 7 includes a toothed gear rim 7a mounted on a collar hub 7b which is fitted onto the slide valve 6. In the housing, radially outwardly from the gear rim 7a and in engagement with it, is a drive pinion 8 rotatably supported in the housing 1. The outside surface of the drive pinion 8 projects from the outside surface of th housing and is used to rotate the slide valve 6 about its axis via the collar 7. At its front end within the bore in the barrel 4, the slide valve 6 has a funnel-like part 6a which opens into the bore immediately rearwardly of the piston 5 in the position shown in FIG. 1. The outside surface of the funnel-like part 6a is frusto-conical for a portion of the axial length of this part and the surface of the barrel bore has a corresponding frusto-conical surface. In the range of this frusto-conical surface, exhaust openings 6b extend radially outwardly from the interior of the bore through the slide valve. By turning the pinion 8 and thereby rotating the slide valve 6 selected ones of the exhaust openings 6b can be aligned with the exhaust duct section 4a located in the barrel. The exhaust duct section 4a extends radially outwardly through the barrel and communicates along an axially extending portion with exhaust duct sections 1a formed in the housing 1. To regulate the driving power generated within a combustion chamber 1c in the housing, a portion of the propellant gases can be by-passed out of one of the openings 6b into the aligned exhaust duct section 4a in the barrel and then through the exhaust sections 1a in the housing. In addition to providing a regulated exhaust flow of the propellant gases, the slide valve 6 has another function.

In the housing rearwardly of the pinion 8 a magazine duct 1b extends approximately perpendicularly of the axis of the barrel 4. A magazine 9 containing caseless propellant charges 10 is located in the magazine duct and the charges can be aligned with the axis of the barrel bore by means well known in the art. When the setting device is to be used, the barrel is located to the left from the position illustrated in FIG. 1 and the slide valve 6 secured to the end of the barrel is also positioned leftward of the position shown. As the front end of the barrel is pressed against the receiving material, the barrel rides in the rightward direction toward the rear end of the housing with the rear end of the slide valve 6 displacing a caseless propellant charge 10 out of the magazine 9 into the combustion chamber 1c. The combustion chamber 1c is formed in the axial direction by the surfaces of the bore in the housing 1 with the forward side of the chamber being formed by the rear end of the slide valve and the rear side of the chamber formed by the front end of a counter support 11. When a caseless propellant charge 10 is ignited, the propellant gases generated flow from the combustion chamber through the bore 6c in the slide valve 6 into a working space 4b formed between the trailing end of the piston 5 and the front end of the slide valve 6. The counter support 11 forming the rear side of the combustion chamber contains means for igniting or firing the caseless propellant charge 10 positioned in the combustion chamber 1c. These ignition means can be in the form of an electrode 12 as shown in FIG. 1.

In the enlarged view in FIG. 2, the barrel 4 and the slide valve 6 are illustrated. In the position shown, there is a separation space between the outside surface of the frusto-conically shaped funnel-like part of the slide valve 4 and the correspondingly frusto-conically shaped surface of the bore in barrel 4. This separation space has an axial dimension designated as A.

In addition, there is another separation space having an axial dimension B formed between the rearward surface of the hub 7b on the collar 7 and the adjacent surface of the housing 1. To permit the funnel-like part 6a of the slide valve to move into sealing contact with the correspondingly shaped frusto-conical surface of the barrel 4, the axial dimension A of the separation space between the slide valve and the barrel must be less than the axial dimension B of the separation space between the hub 7b and the housing 1. As illustrated, the separation space is shown when a propellant charge is ready to be fired. The hub 7b is rigidly connected with the slide valve 6, that is, there is no axial movement between the hub and the slide valve. The hub, however, is connected to the gear rim 7a so that it rotates with the gear rim but is axially movable relative to it. Pin 7c extends from the gear rim 7a into the hub 7b and a key 7d projects from the hub 7b into the slide valve 6. The rotation of the gear rim is transmitted through the pin 7c and the key 7d to the slide valve so that it is turned around its axis extending coaxially with the axis of the bore in the barrel. The axial connection of the hub 7b with the slide valve 6 is effected by a securing ring 7e.

When a propellant charge is ignited within the combustion chamber 1c the propellant gases force the slide valve 6 to move in the direction of the front end of the barrel so that the separation space A, as shown in FIGS. 1 and 2, is present between the frusto-conical surfaces of the slide valve 6 and the barrel 4. As the propellant gases flow through the duct 6c in the slide valve they reach the working space 4b and act on the trailing end of the piston 5 and on the front end of the slide valve 6. The propellant gases within the working space 4b displace the slide valve 6 in the direction opposite to the driving direction of the piston 5 so that the corresponding frusto-conical surfaces on the slide valve and the barrel are placed in sealing contact with one another eliminating the separation space having the axial dimension A and with the separation space having the axial dimension B being reduced to a minimum. As the slide valve moves rearwardly, the exhaust opening 6b aligns with the exhaust duct section 4a and the surfaces around the opening between the exhaust opening and the exhaust duct section are sealed.

While specific embodiments of the invention have been shown and described in detail to illustrate the application of the inventive principles, it will be understood that the invention may be embodied otherwise without departing from such principles.

We claim:

1. An explosive powder operated device for using the propellant gases generated when an explosive powder charge is ignited for driving fastening elements, such as bolts, studs, nails and the like, into a receiving material, comprising a housing having a front end from which the fastening elements are driven and a rear end, a barrel forming an axially extending bore and having a front end and a rear end and being slidably mounted in said housing for movement in the front end and rear end direction, said housing having at least one exhaust duct section for discharging propellant gases, said barrel having an exhaust duct section in communication with said exhaust duct section in said housing, means in combination with said housing forming a combustion chamber for the explosive powder charge with the combustion chamber being located rearwardly of the rear end of said barrel, said means including a tubular slide valve rotatably mounted in the rear end of said barrel, said slide valve having a front end located within said barrel and a rear end forming a part of said combustion chamber, a piston slidably mounted in the bore in said barrel for displacement toward the front end of said barrel with said piston located forwardly of the front end of said slide valve so that said piston can be driven toward the front end of said barrel by propellant gases for driving a fastening element out of the barrel into the receiving material, said barrel in combination with the front end of said slide valve forming a working space for receiving propellant gases through said slide valve from said combustion chamber so that the propellant gases can drive said piston toward the front end of said barrel, means for securing said slide valve within said barrel for permitting limited axial displacement of said slide valve relative to said barrel, said slide valve having a funnel-like part at the front end thereof with a frusto-conically shaped outside surface widening in the direction toward the front end of said barrel, said barrel having a corresponding frusto-conically shaped inside surface in the bore thereof arranged to receive said funnel-like part in surface contact for providing a seal therebetween, said funnel shaped part limiting the axial movement of said slide valve in the direction toward the rear end of said barrel, and said slide valve having radially extending openings therethrough from the inside to the outside surfaces thereof so that at least one of the openings can be aligned with said exhaust duct section in said barrel for releasing a selected amount of the propellant gases from the working space for regulating the amount of the propellant gases available for driving said piston.

2. An explosive powder operated device, as set forth in claim 1, wherein said radially extending openings in said slide valve being located in the axially extending region of said funnel-like part.

3. An explosive powder operated device, as set forth in claims 1 or 2, wherein said means for securing said slide valve within said barrel comprises a stop secured to said slide valve and disposed in contact with the rear end of said barrel.

4. An explosive powder operated device, as set forth in claim 3, wherein said stop comprises an annular collar encircling said slide valve between the front end and rear end thereof.

5. An explosive powder operated device, as set forth in claim 4, wherein said stop includes means for rotating said slide valve about the axis of said barrel.

6. An explosive powder operated device, as set forth in claim 5, wherein said means for rotating said slide valve comprises a toothed gear rim forming a portion of said collar, a pinion rotatably mounted in said housing and disposed in meshed engagement with said gear rim, and said pinion being accessible on the outside surface of said housing so that by rotating said pinion said gear rim through said collar rotates said slide valve for selectively locating at least one of said radially extending openings in said slide valve in alignment with said exhaust duct section in said barrel.

7. An explosive powder operated device, as set forth in claim 6, wherein said collar includes a hub secured to said slide valve for axial movement with said slide valve, said hub being axially displaceable relative to said gear rim.

8. An explosive powder operated device, as set forth in claim 1, wherein said slide valve being axially displaceable between a first position and a second position spaced axially rearwardly of said first position, in said first position the frusto-conically shaped outside surface of said funnel-like part being spaced from the corresponding frusto-conically shaped inside surface in the bore of said barrel and in the second position said frusto-conically shaped outside surface of said funnel-like part being in sealing contact with the corresponding frusto-conically shaped inside surface in the bore of said barrel.

9. An explosive powder operated device, as set forth in claim 8, wherein said means for securing said slide valve within said barrel comprising a collar secured to said slide valve and located at the rear end of said barrel, said collar including a hub secured to said slide valve and axially displaceable relative to said barrel, the rear end of said hub being disposed in spaced relation to the adjacent surface of said housing so that said hub is axially displaceable toward the adjacent surface of said housing when said frusto-conically shaped outside surface of said funnel-like part is disposed into sealing contact with the corresponding frusto-conically shaped inside surface in the bore of said barrel.

* * * * *